US007333010B2

(12) United States Patent
Barrieau et al.

(10) Patent No.: US 7,333,010 B2
(45) Date of Patent: Feb. 19, 2008

(54) METHOD AND APPARATUS FOR VERIFYING OPERATION OF NOTIFICATION APPLIANCES DURING LOW INPUT VOLTAGE CONDITION

(75) Inventors: Mark P. Barrieau, Baldwinville, MA (US); Jeffrey R. Brooks, Ashburnham, MA (US); Anthony J. Capowski, Westford, MA (US); Kenneth E. Savage, Jr., Fitchburg, MA (US); Daniel J. Gauvin, Templeton, MA (US)

(73) Assignee: SimplexGrinnell LP, Westminster, MA (US)

( * ) Notice: Subject to any disclaimer, the term of this patent is extended or adjusted under 35 U.S.C. 154(b) by 277 days.

(21) Appl. No.: 11/282,358

(22) Filed: Nov. 18, 2005

(65) Prior Publication Data

US 2006/0214811 A1 Sep. 28, 2006

Related U.S. Application Data

(60) Provisional application No. 60/665,449, filed on Mar. 25, 2005.

(51) Int. Cl.
*G08B 29/00* (2006.01)

(52) U.S. Cl. ..... 340/514; 340/506; 340/508; 340/286.05

(58) Field of Classification Search ..... 340/286.05, 340/286.02, 514, 506–509, 577, 660; 702/58, 702/63

See application file for complete search history.

(56) References Cited

U.S. PATENT DOCUMENTS

| | | | | |
|---|---|---|---|---|
| 3,641,570 | A * | 2/1972 | Thompson | 340/508 |
| 3,665,461 | A * | 5/1972 | Gnagi et al. | 340/509 |
| 4,274,087 | A * | 6/1981 | Swanson et al. | 340/525 |
| 4,777,473 | A * | 10/1988 | Weston et al. | 340/514 |
| 5,705,979 | A * | 1/1998 | Fierro et al. | 340/517 |
| 5,754,103 | A * | 5/1998 | Kanai et al. | 340/507 |
| 6,034,601 | A * | 3/2000 | Barrieau et al. | 340/514 |
| 6,104,286 | A * | 8/2000 | Luquette | 340/506 |
| 6,313,744 | B1 | 11/2001 | Capowski et al. | |
| 6,502,044 | B1 * | 12/2002 | Lane et al. | 702/63 |
| 6,567,001 | B1 * | 5/2003 | Barrieau et al. | 340/506 |
| 2007/0001819 | A1 * | 1/2007 | Becker et al. | 340/286.05 |
| 2007/0115111 | A1 * | 5/2007 | Girouard | 340/507 |

* cited by examiner

*Primary Examiner*—Jeffery Hofsass
*Assistant Examiner*—Anne V. Lai

(57) ABSTRACT

A method for verifying operation of notification appliances on a notification appliance network during low input voltage conditions is provided. An output voltage is supplied to a network and is measured at a control panel. An input parameter is measured at a notification appliance connected to the network. A supply line impedance is calculated for the notification appliance based on at least one of the output voltage and the input parameter. At least one of the supply line impedance, the output voltage and the input parameter are used to determine a pass/fail condition for the notification appliance during a low voltage condition.

22 Claims, 4 Drawing Sheets

METHOD AND APPARATUS FOR VERIFYING OPERATION OF NOTIFICATION APPLIANCES DURING LOW INPUT VOLTAGE CONDITION

CROSS REFERENCE TO RELATED APPLICATIONS

The application relates to and claims priority from provisional patent application Ser. No. 60/665,449, titled "METHOD AND APPARATUS FOR VERIFYING INSTALLATION OF NOTIFICATION APPLIANCES", filed Mar. 25, 2005, the complete subject matter of which is expressly hereby incorporated herein in its entirety.

BACKGROUND OF THE INVENTION

This invention relates generally to fire alarm systems, and more particularly, to methods and apparatus for verifying power conditions at notification appliances during low voltage situations.

Notification appliances are typically installed as part of fire alarm systems. During the installation process, the appliances need to be verified to ensure operation under all designated circumstances. Under normal operating conditions, an AC branch circuit provides a primary source of power to a control panel. This is the condition under which the system is typically checked for proper operation. Under this condition, the notification appliances are likely to have adequate operating voltage and will operate properly.

Fire alarm systems typically have a secondary source of power, such as storage batteries. Fire alarm codes, such as NFPA 72, require that the system be operable for a minimum period of time when using the secondary power source, such as 24 hours, 60 hours or other length of time specified by the Authority Having Jurisdiction (AHJ).

As the batteries are discharged, the output voltage supplied to the notification appliances decreases. Therefore, the system is required, such as by Underwriter's Laboratories, to operate with the power source at 85% of the rated input voltage. For example, a fire alarm system may utilize 24V batteries as standby power sources. In this case, the system is specified to be fully operational when the battery voltage is reduced to 20.4V. The intent of the codes and standards is that the system will operate for the specified standby period after which the system must operate in the alarm condition. The alarm condition is the most severe load condition for the system.

The wiring to all alarm devices and appliances is to be verified upon installation to ensure the input voltage and current limitations for each notification appliance remain within the specified range for operation. Many of the notification appliances in use are "constant power" loads. Therefore, when input voltage is reduced, the current increases, and the current draw of a notification appliance at reduced voltage is higher than when the input voltage is at the normal operating voltage. The increase in current draw at lower voltages also results in greater line loss than when operating under normal conditions. When the system is verified during installation, the wiring distance may be verified to ensure that the wiring voltage loss to each notification appliance does not reduce the input voltage to any notification appliance on the circuit to below the rated input voltage.

Notification appliances may be wired as notification circuits or as signaling lines. When wired as notification circuits, the wiring is routed from the control panel to each device in succession. When wired as signaling lines, the wires may spoke off to form multiple wiring runs, each of which has a different wire resistance that is unknown to any degree of accuracy.

Installation verification methods vary, but overall are time-consuming, expensive, and often inadequate and prone to error when testing actual low input voltage conditions. In addition, the labor required to properly test the system is expensive, and schedule and/or financial pressure could cause an installer to forego a complete and accurate verification. For example, operating the system at normal input voltage and observing all notification appliances for proper operation does not verify that the system will operate properly at low input voltage. The voltage may be manually measured at each appliance, which verifies adequate voltage under normal operating conditions, but does not confirm the voltage level under a low voltage condition. The worst-case voltage drop for each wiring run may be calculated based on low-battery operation, but this method often results in severely limiting wiring distance, which is undesirable.

In addition, the line losses are difficult to estimate as the current varies across the entire length of the circuit. As stated previously, line loss increases with lower input voltage. Thus, if the voltage is measured at a remote notification appliance under normal operating conditions, calculating the worst-case condition by determining the present line loss and subtracting it from the low input voltage is not accurate.

Alternatively, the system may be operated from the secondary (battery) source for the specified standby period. At the end of the standby period, the system is operated in the alarm state and the notification appliances are verified. This method is very costly, time consuming and potentially disruptive. In addition, it is difficult to precisely discharge the batteries, and an over-discharge condition can permanently damage the batteries.

Therefore, a need exists for a method and apparatus for verifying the operation of notification appliances during a low input voltage condition. Certain embodiments of the present invention are intended to meet these needs and other objectives that will become apparent from the description and drawings set forth below.

BRIEF DESCRIPTION OF THE INVENTION

In one embodiment, a method for verifying operation of notification appliances on a notification appliance network during low input voltage conditions comprises measuring an output voltage at a control panel. The output voltage is supplied to a network. An input parameter is measured at a notification appliance connected to the network. A supply line impedance is calculated for the notification appliance based on at least one of the output voltage and the input parameter. At least one of the supply line impedance, the output voltage and the input parameter are used to determine a pass/fail condition for the notification appliance during a low voltage condition.

In another embodiment, a method for verifying installation of notification appliances on a notification appliance network comprises reducing an output voltage from a control panel to a level based on a low line condition. The output voltage is supplied to a network. An input voltage is measured at a notification appliance connected to the network. The input voltage is compared to a low input voltage threshold, and one of a pass indication and a fail indication is provided based on the comparing step.

In another embodiment, an alarm system comprises a control panel providing an output voltage to a network. A notification appliance communicates with the control panel over the network and includes an alarm indicator and a control module configured to turn on/off the alarm indicator. The control module is configured to receive command instructions from the control panel and to sample an input level. The control module directs operation of the alarm indicator based on the command instructions. A fault indicator indicates a relationship between the input voltage level and a low line condition.

Figure 1:
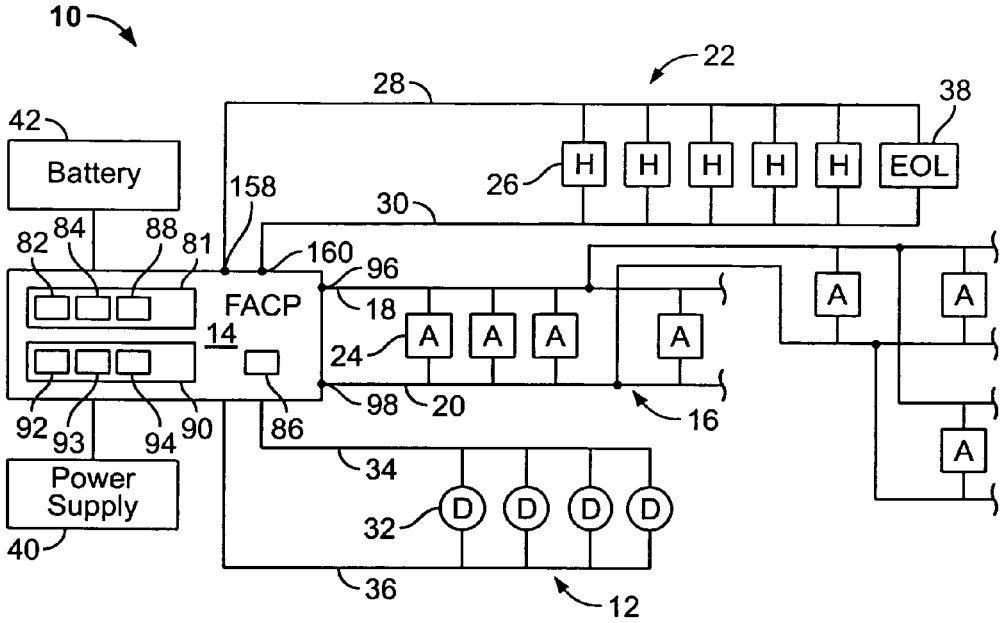
FIG. 1 illustrates an alarm system in accordance with an embodiment of the present invention.

The foregoing summary, as well as the following detailed description of certain embodiments of the present invention, will be better understood when read in conjunction with the appended drawings. The figures illustrate diagrams of the functional blocks of various embodiments. The functional blocks are not necessarily indicative of the division between hardware circuitry. Thus, for example, one or more of the functional blocks (e.g., processors or memories) may be implemented in a single piece of hardware (e.g., a general purpose signal processor or a block or random access memory, hard disk, or the like). Similarly, the programs may be stand-alone programs, may be incorporated as subroutines in an operating system, may be functions in an installed imaging software package, and the like. It should be understood that the various embodiments are not limited to the arrangements and instrumentality shown in the drawings.

DETAILED DESCRIPTION OF THE INVENTION

FIG. 1 illustrates an alarm system 10 in accordance with an embodiment of the present invention. The system 10 includes one or more detector networks 12 having individual alarm condition detectors 32 which are monitored by a fire alarm control panel (FACP) 14. The detectors 32 may detect fire, smoke, temperature, chemical compositions, or other conditions. The alarm condition detectors 32 are coupled across a pair of power lines 34 and 36. When an alarm condition is sensed, the FACP 14 signals the alarm to the appropriate notification devices through one or more networks 16 of addressable alarm notification appliances 24 and/or one or more networks 22 of hardwired (e.g. non-addressable) alarm notification appliances 26. The networks 16 and 22 are also referred to as notification appliance circuits (NAC).

Wiring is used to form the networks 16 and 22. The length of wire, wire size and notification appliance load all vary according to specific requirements for each installation. Each length of wire has unique voltage loss characteristics, making the voltage at the input terminals of each notification appliance 24 and 26 different with respect to each other as well as the voltage at the output terminals of the FACP 14, even if each notification appliance 24 and 26 on the network 16 and 22 is of the same type. For notification appliances 24 and 26 that are constant power devices, the different voltage levels result in a different current draw for each notification appliance 24 and 26.

The FACP 14 is connected to a power supply 40 which provides one or more levels of voltage to the system 10. The power supply 40 may be an AC branch circuit. One or more batteries 42 provide a back-up power source for a predetermined period of time in the event of a failure of the power supply 40 or other incoming power. Other functions of the FACP 14 include displaying the status of the system 10 and/or installed component, resetting a part or all of the system 10, silencing signals, turning off strobe lights, and the like.

The FACP 14 has a control module 81 which provides control software and hardware to operate the system 10. Control logic 82, a voltage monitor 84 and a memory may be provided within the control module 81. An input/output (I/O) port 86 allows communication with external devices such as a laptop computer. Alternatively, the FACP 14 may have wireless capability, allowing wireless communication between the FACP 14 and the external device. A voltage reducing circuit 90 receives commands from the control module 81 and is further discussed below.

The FACP 14 may access and run a low input voltage test to verify that adequate voltage will be supplied to all notification appliances 24 and 26 under a worst-case condition. By way of example only, the worst-case condition may be based on 85% of the battery 42, such as 20.4 V, wherein a voltage level such as 19.5V is output at the terminals of the FACP 14. The worst-case output voltage is known and stored, such as in memory 88. A pass/fail condition for each notification appliance 24 and 16 may be based on calculated equivalent source impedance and a calculated voltage expected at input terminals of each of the notification appliances 24 and 26 under the worst-case condition.

The addressable notification appliances 24 are coupled to the FACP 14 across a pair of lines 18 and 20 that are configured to carry power and communications, such as command instructions. The notification appliances 24 may be wired in a fashion referred to as "T-tapped". Therefore, multiple branches or spokes may be tapped and run off into different directions, creating multiple lines operating in parallel. For example, lightly loaded spokes may have a greater length and heavily loaded spokes may have a shorter length while being connected to the same network 16. Supervision of the notification appliances 24 occurs by polling each notification appliance 24. The notification appliances 24 each have a unique address and both send and receive communications to and from the FACP 14. Therefore, the addressable notification appliances 24 may communicate their status and functional capability to the FACP 14 over the lines 18 and 20. The communication between the FACP 14 and the addressable notification appliances 24 may be accomplished in various ways, such as described in U.S. Pat. No. 6,313,744 (Capowski et al.), which is incorporated herein by reference in its entirety.

The hardwired notification appliances 26 are coupled with the FACP 14 across a pair of lines 28 and 30. A notification signal sent on the network 22 from the FACP 14 will be received by each hardwired notification appliance 26. An end of line (EOL) device 38 interconnects the ends of the lines 28 and 30 opposite the FACP 14. The EOL device 38 may be a resistor and/or provide testing and status capabilities as discussed further below.

Each of the notification appliances 24 and 26 is set for one of several output ratings, such as 15 or 110 candela (cd) in the case of strobes, or 85 or 100-decibel in the case of horns. The output rating impacts the current draw of the notification appliance 24 and 26, which may be measured at the input terminals or may be calculated based on by the input voltage at its terminals and the output setting. By way of example only, a notification appliance 24 having a multi-candela strobe may be set to 15 cd. Over a range of input voltages, such as from 16 to 33 VDC, the notification appliance 24 may require approximately 1 watt for operation. Therefore, 1 watt may be assigned as the constant-power rating for the 15 cd strobe. The power required at 85 cd would be different.

Two normal modes of operation within the system 10 are SUPERVISORY mode and ALARM mode. In the SUPERVISORY mode, the FACP 14 applies, for example, 8 to 9 VDC (a notification signal, power level, voltage level, and the like) to the networks 16 and 22. The positive signal may be applied to lines 18 and 30, for example. Therefore, enough power is provided to support two-way communications between the FACP 14 and the notification appliances 24 on network 16, and monitoring of the network 22 for integrity by the EOL device 38 and FACP 14. A diode or other component is used within the hardwired notification appliances 26 to prevent voltage from powering the indicator circuits while in the SUPERVISORY mode.

In the ALARM mode, the FACP 14 may apply a nominal 24 VDC (notification signal) to the networks 16 and 22, supplying power to operate the audible and visible indicator circuits of the notification appliances 24 and 26. The FACP 14 again applies the positive signal to line 18, but reverses the polarity on lines 28 and 30 so that the power to the audible and visible indicator circuits within the hardwired notification appliance 26 is no longer blocked by the diode. It should be understood that the voltages applied during each of the SUPERVISORY and ALARM modes may be different depending upon the type of notification appliance installed on each network and may be governed by applicable codes and governing bodies.

Figure 2:
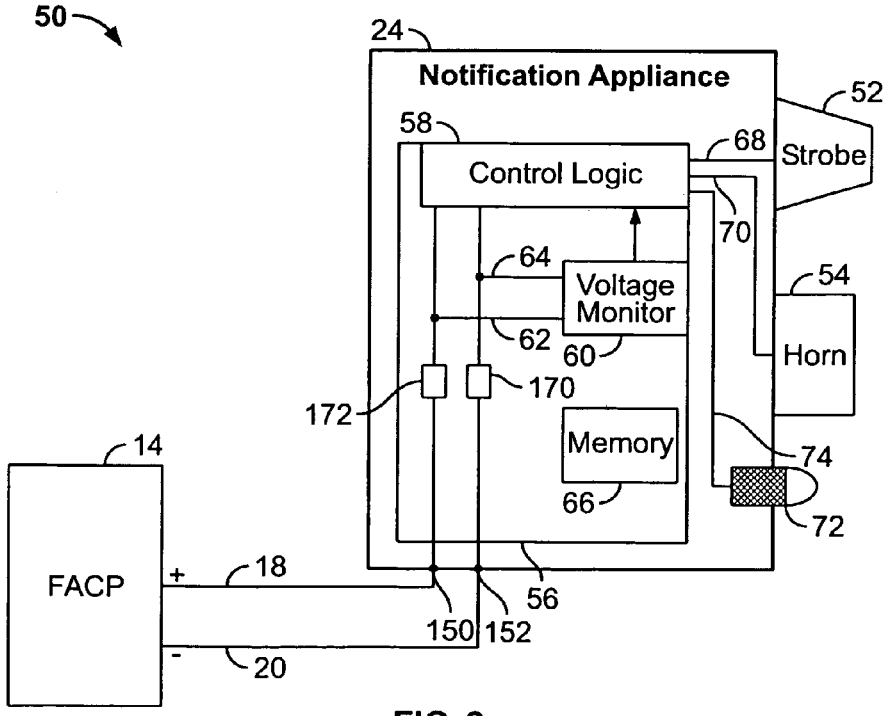
FIG. 2 illustrates a notification appliance circuit (NAC) of the alarm system (FIG. 1) with an addressable notification appliance having low input voltage testing capability in accordance with an embodiment of the present invention.

FIG. 2 illustrates an NAC 50 of the alarm system 10 with an addressable notification appliance 24 having low input voltage testing capability in accordance with an embodiment of the present invention. The addressable notification appliance 24 is interconnected with the FACP 14 as discussed previously. It should be understood that additional appliances and/or other devices may be installed on the NAC 50.

The notification appliance 24 has a control module 56 receiving command instructions, notification signals and power over the lines 18 and 20. The command instructions may, for example, be a signal indicating that the addressable notification appliance 24 should perform a desired test, power an alarm indicator, or return a status response. The control module 56 has control logic 58 that implements notification applications by processing the command instructions and initiating the desired action. The control module 56 may further comprise a microcontroller or microprocessor program execution and/or an analog to digital converter for conducting the low input voltage test.

One or more alarm indicators, such as strobe 52 and horn 54, are controlled by the control module 56 through lines 68 and 70, respectively. A fault indicator 72 is controlled by the control module 56 through line 74 and is visible from outside the notification appliance 24. The fault indicator 72 may be a single LED, multiple LEDs, one or more colored LEDs, a small display for displaying a number or alpha based code, and the like. The fault indicator 72 may also be a status indicator, such as an LED, for communicating various information and states. For example, the fault indicator 72 may indicate a circuit or component failure, or a status result after testing the notification appliance 24, such as a result of the low input voltage test. The fault indicator 72 may be operated at a first rate to indicate a pass condition and at a second rate to indicate a fail condition. The different rates may instead constitute different on/off duty cycles or other patterns.

A voltage monitor 60 may sample the lines 18 and 20 with lines 62 and 64 to read the input voltage level. Further calculations described below (FIG. 5) may use the input voltage level to determine whether the notification appliance 24 will operate in a low input voltage condition. Alternatively, the sampled voltage or signals may be compared to a range or a minimum low input voltage threshold during a low input voltage test. Based on the comparison, the control module 56 outputs an appropriate signal to the fault indicator 72 and/or a pass/fail result to the FACP 14. The range or minimum low input voltage threshold is determined by the type of the notification appliance 24 and may be stored in a memory 66 or be accomplished through other circuitry, such as a voltage sensitive trigger (not shown).

A current monitor 170 or 172 may be interconnected with the lines 18 or 20 and used to measure the current draw in addition to, or instead of, sampling the input voltage. It should be understood that a single current monitor 170 or 172 may be used. The current monitor 170 and 172 may use components such a sense resistor and differential amplifier. The control logic 58 may command the current monitor 170 or 172 to sample the current draw, and then uses the sampled current draw to further calculate input voltage and the equivalent wiring impedance.

Figure 3:
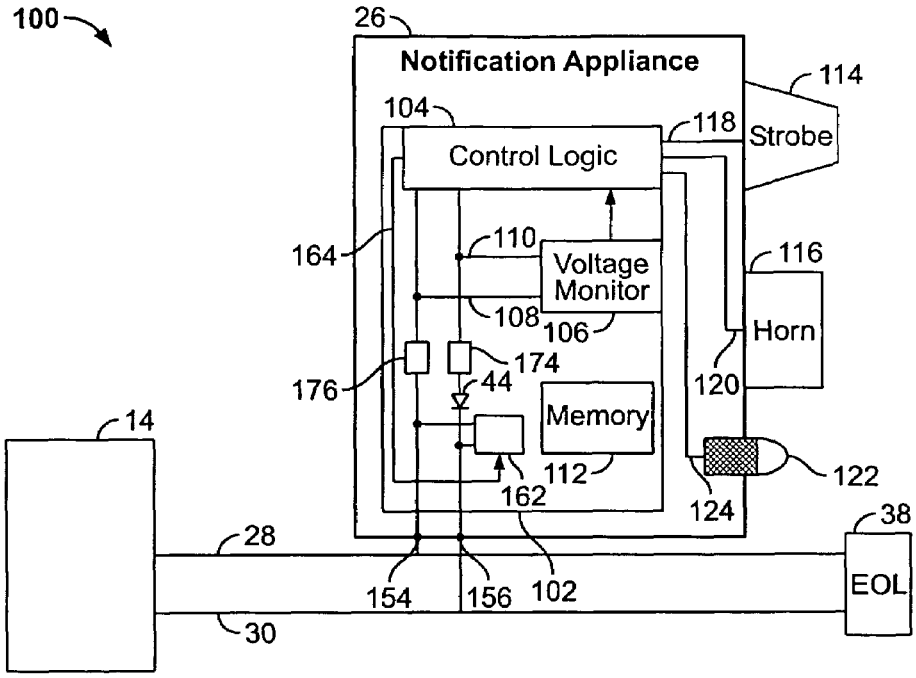
FIG. 3 illustrates an NAC of the alarm system (FIG. 1) with a hardwired notification appliance having low input voltage testing capability in accordance with an embodiment of the present invention.

FIG. 3 illustrates an NAC 100 of the alarm system 10 with a hardwired notification appliance 26 having low input voltage testing capability in accordance with an embodiment of the present invention. The hardwired notification appliance 26 is interconnected with the FACP 14 and EOL device 38 as discussed previously. Additional appliances and/or devices may be installed on the NAC 100. In SUPERVISORY mode, the FACP 14 may output a positive level on the line 30, which is blocked by diode 44 or other component from powering the indicator circuits. In ALARM mode, polarity is reversed and the positive level is output on line 28. The hardwired notification appliance 26 has a control module 102 receiving voltage, notification signals and command instructions over the lines 28 and 30 when in ALARM mode. The control module 102 has control logic 104 for initiating the desired action.

The hardwired notification appliance 26 has one or more alarm indicators, such as strobe 114 and horn 116, which are controlled by the control module 102 through lines 118 and 120, respectively. A fault indicator 122 is controlled by the control module 102 through line 124. As discussed previously, the fault indicator 122 may be a single LED, multiple LEDs, one or more colored LEDs, a small display or other indicator visible from outside the notification appliance 26.

While in ALARM mode, a voltage monitor 106 may sample the lines 28 and 30 with lines 108 and 110 to read the input voltage level. The voltage monitor 106 or control logic 104 conducts a low input voltage test to determine whether the notification appliance 26 will operate during a low input voltage condition by comparing the sampled voltage to a range or threshold, and may output a signal on the fault indicator 122. The range and/or threshold may be stored in a memory 112 or other circuitry. A current monitor 174 or 176, as discussed previously with FIG. 2, may be used to measure the current draw instead of, or in addition to, sampling the input voltage. Alternatively, a shunting component 162, such as a shunting resistor, may receive a control signal from the control logic 104 over line 164. The control logic 104 may command the shunting component 162 to interconnect the lines 28 and 30 to indicate a fault. The shunting component 162 changes the impedance over the NAC 100 which is detected by the FACP 14.

Figure 4:
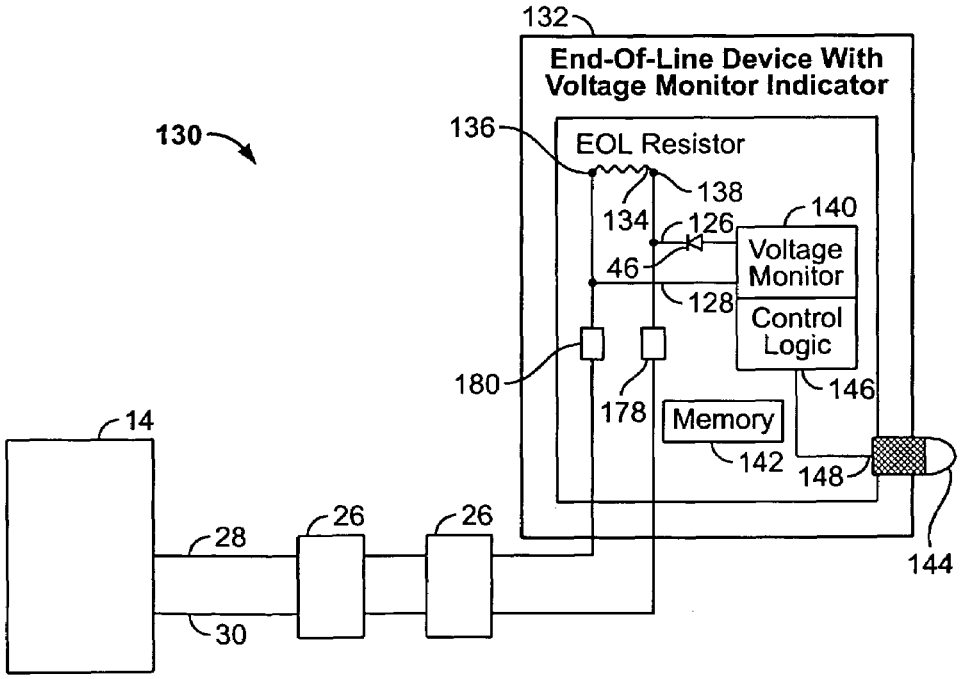
FIG. 4 illustrates an NAC of the fire alarm system (FIG. 1) with an EOL device having low input voltage testing capability in accordance with an embodiment of the present invention.

FIG. 4 illustrates an NAC 130 of the fire alarm system 10 with an EOL device 132 having low input voltage testing capability in accordance with an embodiment of the present invention. The EOL device 132 is interconnected with the FACP 14 and one or more hardwired notification appliances 26 as discussed previously. It should be understood that additional notification appliances 26 and/or other types of devices may be installed on the NAC 130.

The EOL device 132 has an EOL resistor 134 connected at first and second ends 136 and 138 to the end of the lines 28 and 30 opposite the FACP 14. Optionally, a diode 46 or other component may be used to block the power when the NAC 130 is operating in SUPERVISORY mode. In ALARM mode, a voltage monitor 140 samples the voltage level on the lines 28 and 30 with lines 126 and 128 to read the voltage drop across the EOL resistor 134. The voltage monitor 140 or control logic 146 conducts a low input voltage test based on, for example, a range or minimum low input voltage threshold applicable to the hardwired notification appliances 26 installed on NAC 130. The range and/or minimum low input voltage threshold may be stored in a memory 142. A current monitor 178 or 180 may also be used within the EOL device 132 to measure the current draw as previously discussed.

The EOL device 132 has a fault indicator 144 which is controlled by control logic 146 through line 148. The fault indicator 144 provides a fault indication for the NAC 130, and thus provides a fault indication for each notification appliance 26 connected on lines 28 and 30. The EOL device 132 may be installed with notification appliances and/or other devices which have the same operating range. The EOL device 132 may be added to an existing installation to monitor circuit loading for voltage drop conditions. Thus, it may not be necessary to test for a low input voltage condition at each interconnected device. As discussed previously, the fault indicator 144 may be a single LED, multiple LEDs, one or more colored LEDs, a small display or other indicator and is visible from outside the unit.

It should be understood that the functionality of the voltage monitor 60 and memory 66 (FIG. 2) may be integrated into the addressable notification appliance 24 and/or installed as an option on existing and/or already installed notification appliances 24. Similarly, the voltage monitor 106, memory 112 and fault indicator 122 (FIG. 3) may be integrated into the hardwired notification appliance 26 and/or existing hardwired notification appliances 26. Also, circuitry such as the voltage monitor 140, control logic 146, memory 142 and fault indicator 144 (FIG. 4) may be integrated into new, or added to existing, EOL devices 132.

Figure 5:
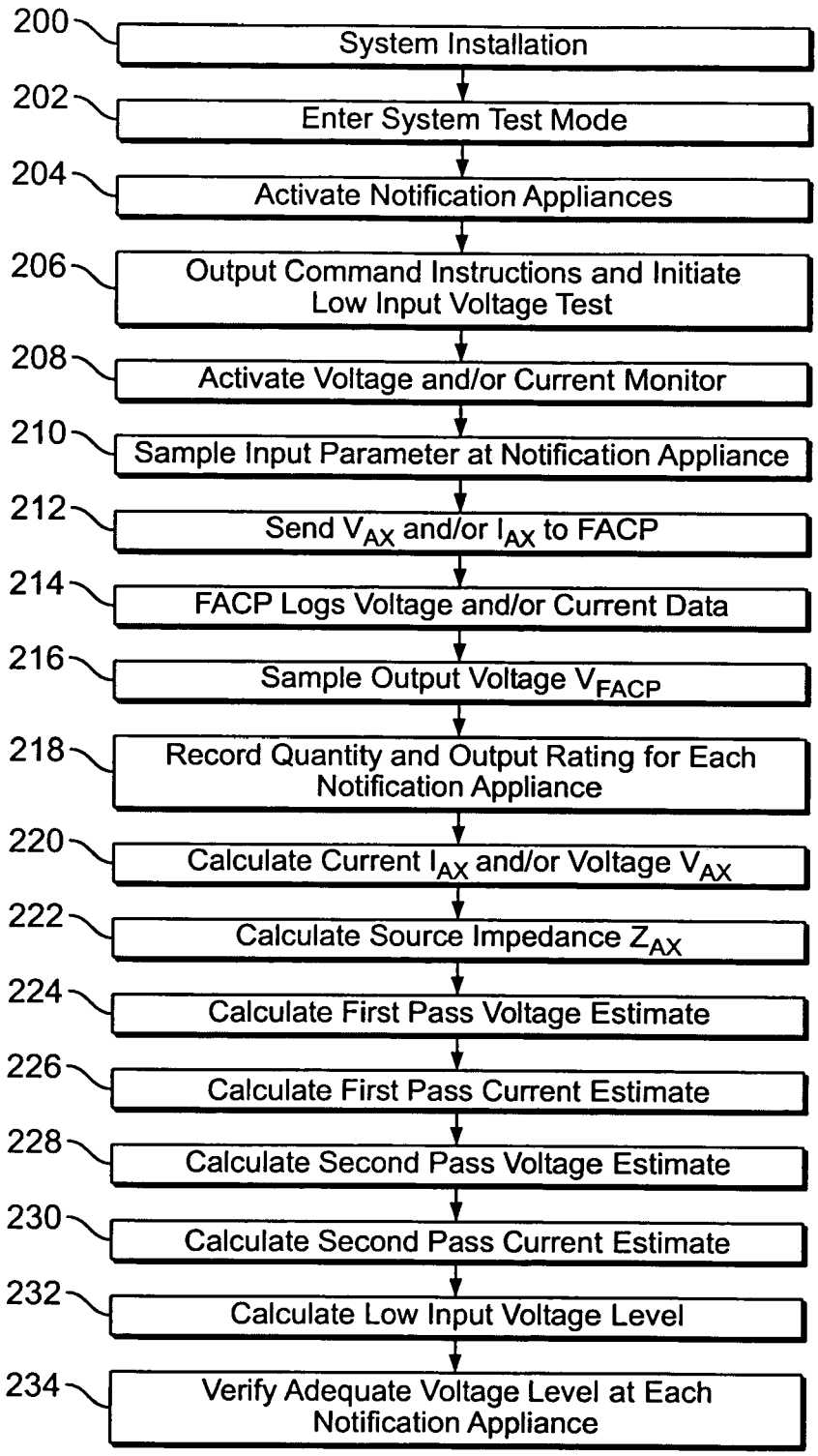
FIG. 5 illustrates a method for performing a low input voltage test in accordance with an embodiment of the present invention.

FIG. 5 illustrates a method for performing a low input voltage test in accordance with an embodiment of the present invention. The low input voltage test verifies that each notification appliance 24 and 26 installed in the system 10 will operate properly during a low input voltage condition such as that experienced at the end of a minimum operating time on battery power. It should be understood that one or more of the following steps may be performed manually. The low input voltage test may be conducted when the system 10 is installed and/or during maintenance and routine testing to verify proper system operation. In addition, the low input voltage test may be conducted to verify whether system capacity is available for adding additional devices. The method of FIG. 5 is initially discussed wherein the addressable notification appliances 24 are both automatically and individually tested. Therefore, the exact configuration of the system 10 need not be known. Embodiments for combining automatic, semi-automatic and manual testing, as well as combinations thereof, are also discussed.

At step 200, the notification appliances 24 and 26, the alarm condition detectors 32, and the FACP 14 are installed and programmed during system installation. Each of the alarm condition detectors 32 are associated with one or more of the notification appliances 24 and 26. When an alarm condition is detected by one of the alarm condition detectors 32, the FACP 14 notifies and/or supplies appropriate voltage to the associated notification appliances 24 and 26 which output the desired alarm condition.

At step 202, a SYSTEM TEST MODE is entered at the FACP 14. By way of example only, the SYSTEM TEST MODE may provide multiple system tests from which to choose, one of which being the low input voltage test. At step 204, the notification appliances 24 are activated at normal operating voltages. Therefore, the low input voltage test is conducted using the power supply 40 and without using the battery 42. At step 206, the FACP 14 initiates the low input voltage test by outputting a command instruction addressed to each of the notification appliances 24, commanding the control module 56 to conduct the low input voltage test.

At step 208, the control module 56 of the notification appliance 24 receives the command instruction to conduct the low input voltage test and activates at least one of the voltage monitor 60 and the current monitor 170. At step 210, the control logic 58 samples an input parameter, such as by commanding the voltage monitor 60 to read the input voltage level $V_{Ax}$ on lines 62 and 64, wherein $V_{Ax}$ indicates voltage at a notification appliance Ax, each notification appliance 24 having a different identifying X. Alternatively, the control logic 58 may command the current monitor 170 to read the current draw $I_{Ax}$. Therefore, obtaining the input voltage level $V_{Ax}$ and/or current $I_{Ax}$ are automatically performed by electronic components. Optionally, $V_{Ax}$ and $I_{Ax}$ may be obtained manually by measuring at input terminals 150 and 152 of each notification appliance 24.

At step 212, the control module 56 sends the voltage $V_{Ax}$ and/or current $I_{Ax}$ measurement to the FACP 14 in a packet of data during an automated report-back to the FACP 14. At step 214, the FACP 14 logs the measurement data from each notification appliance 24, creating a file that may be available for review by service and public safety personnel. The file may be stored in the memory 88 and may be accessible through the FACP 14 and/or downloadable to an external computer through the I/O port 86.

At step 216, the voltage monitor 84 of the FACP 14 samples the voltage ($V_{FACP}$) output power lines to each NAC, such as the networks 16 and 22. Alternatively, the voltage at output terminals 96, 98, 158 and 160 may be manually obtained and recorded. Optionally, the control module 81 may measure the current at the output terminals 96, 98, 158 and 160 to each NAC.

At step 218, the number of notification appliances 24 and the candela or other output rating of each notification appliance 24 on the NAC is recorded. The output setting of each notification appliance 24 may be fixed, user set or programmable. By way of example, each notification appliance 24 may send a signal to the FACP 14 with information regarding its own output setting. This may be implemented using the microcontroller and analog to digital converter combination within the control module 56. The microcontroller may access data stored in memory 66 to determine the applicable operating power for the notification appliances 24. The device power is known, and may be stored, such as in table form, in memory 66. It is desirable that the total number of notification appliances 24 interconnected with the system 10 be known to verify that each is communicating information to the FACP 14. As previously discussed, by knowing the candela (or other output) setting of each appliance or device, the power demand of each notification appliance 24 is likewise known, since the manufacturer can easily determine this data for any operating voltage point.

At step 220, the control logic 82 of the FACP 14 calculates the current $I_{Ax}$ or input voltage $V_{Ax}$ into each of the addressable notification appliances 24 using the measured value from step 210 and the known power consumption sent by the notification appliance 24 in step 218. The current $I_{Ax}$ or $V_{Ax}$ is calculated using Equation 1:

$$I_{Ax}=P_{Ax}/V_{Ax} \qquad \text{Equation 1}$$

Optionally, the control logic 58 of each of the notification appliances 24 may calculate the current $I_{Ax}$ or input voltage $V_{Ax}$ and then send the result to the FACP 14, in addition to or instead of, the packet sent in step 212.

In step 222, the control logic 82 of the FACP 14 calculates a supply line impedance $Z_{Ax}$ seen by each of the notification appliances 24 using Equation 2:

$$Z_{Ax}=(V_{FACP}-V_{Ax})/I_{Ax} \qquad \text{Equation 2}$$

It should be noted that varying levels of output voltage $V_{FACP}$ may be used without negatively impacting the calculation of the supply line impedance $Z_{Ax}$.

In step 224, the control logic 82 calculates a first pass estimate for the voltage level at each notification appliance 24 when the power supply is operating from a low input voltage regulatory limit, such as when the system 10 has been operating on power from the battery 42 for the required time. An FACP minimum terminal voltage $V_{FACPmin}$ and $VPS_{min}$ at the regulatory low voltage limit is predetermined, taking losses from harness and circuitry at the battery 42, power supply 40 and FACP 14 into account. The values reflecting the relationship between the voltage level at the output terminals 96 and 98 or 158 and 160 of the FACP 14 and the input voltage from the battery 42 may be stored in a look-up table of data in the memory 88 and accessed by the control logic 82. The first pass estimate for voltage may be calculated with Equation 3:

$$V_{Ax_est1}=V_{FACPmin}-(I_{Ax}*Z_{Ax}*(V_{FACP}/V_{FACPmin})) \qquad \text{Equation 3}$$

wherein $(I_{Ax}*Z_{Ax}*(V_{FACP}/V_{FACPmin}))$ is an estimate of the line voltage drop. $V_{FACPmin}$ represents the voltage at the NAC output terminals 96 and 98 under worst-case condition.

As actual current increases with decreased voltage, additional estimates are calculated. In step 226, the control logic 82 calculates a first pass estimate for current at each of the notification appliances 24 with Equation 4:

$$I_{Ax_est1}=P_{Ax}/V_{Ax_est1} \qquad \text{Equation 4}$$

In step 228, the control logic 82 calculates a second pass estimate for voltage using the first pass estimates for voltage and current (Equations 3 and 4) in Equation 5:

$$V_{Ax_est2}=V_{Ax_est1}-(Z_{Ax}*I_{Ax_est1}) \qquad \text{Equation 5}$$

In step 230, the control logic 82 calculates a second pass estimate for current using the second pass estimate for voltage (Equation 5) in Equation 6:

$$I_{Ax_est2}=P_{Ax}/V_{Ax_est2} \qquad \text{Equation 6}$$

In step 232, the control logic 82 calculates a final low input voltage level for each of the notification appliances 24 with Equation 7:

$$V_{AxFinal}=V_{FACPmin}-(Z_{Ax}*I_{Ax_est2}) \qquad \text{Equation 7}$$

In step 234, the control logic 82 determines whether each of the notification appliances 24 will have adequate voltage to operate properly when in the low input voltage condition, such as by comparing the final low input voltage level $V_{AxFinal}$ to a predetermined level, such as 17V. The predetermined level may be different for different types of devices. The control logic 82 also verifies that the second current estimate $I_{Ax_est2}$ does not exceed preset levels.

Alternatively, the notification appliances 24 may use a voltage comparator (not shown) within the control module 56. The voltage comparator may have fixed or programmed settings. After sampling the input voltage $V_{Ax}$ in step 210, the voltage comparator compares the input voltage $V_{Ax}$ with one or more settings to determine whether the voltage level will be adequate during a low input voltage condition. The notification appliance 24 then sends a "pass" or "fail" signal to the FACP 14.

It should be understood that the method of FIG. 5 may be implemented by having an installer manually take the measurements noted above for $V_{Ax}$, $I_{Ax}$ and $V_{FACP}$ for one, some, or all components. The calculations may be performed either manually or by using a software tool or application, such as a spreadsheet application with the equations embedded.

The method of FIG. 5 may also be applied to hardwired notification appliances 26. The FACP 14 changes the polarity of power output on lines 28 and 30 of the network 22 (FIG. 1) as discussed previously. An installer may manually measure the voltage $V_{Ax}$ and/or current $I_{Ax}$ at input terminals 154 and 156 of each notification appliance 26. The output voltage at output terminals 158 and 160 of the FACP 14 may be manually taken or automatically sampled by the voltage monitor 84 of the FACP 14 as discussed in step 216. The final low input voltage level may then be calculated using the steps 218-232 or by using a look-up table.

The control logic 104 of the hardwired notification appliances 26 may also calculate current $I_{Ax}$, and may receive the $V_{FACP}$ from the FACP 14. The control logic 104 may then perform the calculations in steps 220-232 and output the pass/fail status using fault indicator 122.

In addition, the EOL device 132 may also conduct the low input voltage test to verify that all hardwired notification appliances 26 have adequate voltage to operate during a low input voltage condition. A pass or fail status may be indicated with fault indicator 144. In the event of a failure indicated by fault indicator 144, the installer may verify all of the notification appliances 26 on the NAC to determine which notification appliances 26, if any, are in failure mode.

The method of FIG. 5 may be simplified by using one or more look-up tables. A look-up table could approximate the calculations describe above in steps 218-232 by performing the calculations in advance. For example, the look-up table may be created and embedded in software stored in memories 88, 66 and/or 112. Such a look-up table would minimize run-time calculations and potential error compared to manual calculations.

Figure 6:
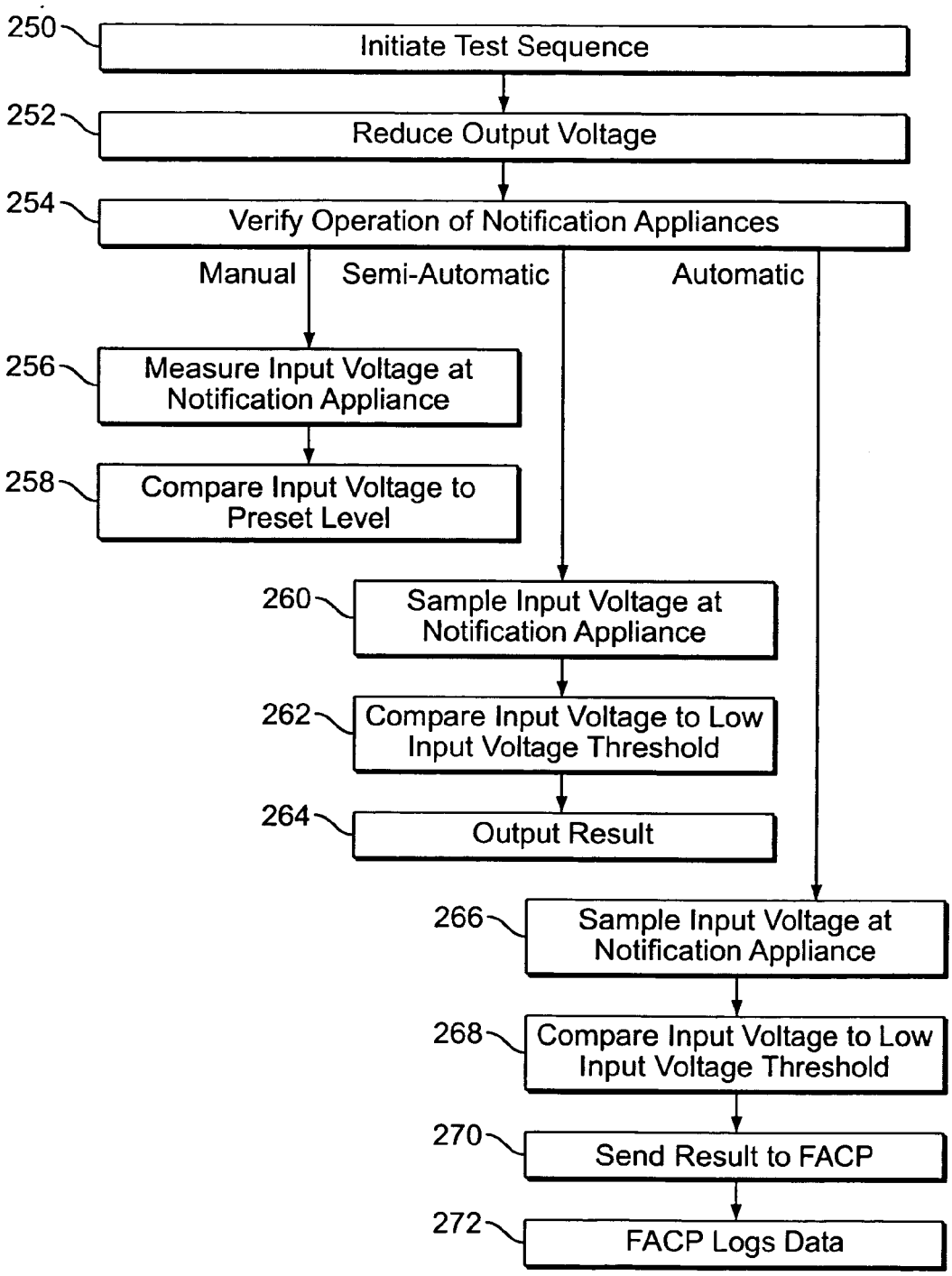
FIG. 6 illustrates a method for simulating low input voltage conditions and verifying that each notification appliance will operate properly in accordance with an embodiment of the present invention.

FIG. 6 illustrates a method for simulating low input voltage conditions and verifying that each notification appliance 24 and 26 installed in the system 10 will operate properly during a low input voltage condition in accordance with an embodiment of the present invention. As with FIG. 5, the method of FIG. 6 allows the system 10 to be tested under normal operating conditions without such steps as discharging the battery 42.

At step 250, a low input voltage test sequence is initiated by service personnel at the FACP 14 while under normal operating conditions. At step 252, the control module 81 activates voltage reducing circuitry 90 to reduce the voltage level output to the networks 16 and 22. The output voltage is reduced to a predetermined level approximating or equivalent to the worst-case voltage level expected and/or experienced under low battery or low input line conditions. The FACP 14 continues to operate under normal voltage conditions throughout the test. The voltage reducing circuitry 90 may include a linear pass element 92 that may be switched in or out of the circuit under control of a microprocessor or microcontroller 93. The voltage reducing circuitry 90 may alternatively include a switchmode regulator 94 with an output setting that may be changed to reduce the output voltage to the desired level. The voltage reducing circuitry 90 may also utilize feedback control (not shown) to more precisely set the output voltage. It should be understood that other voltage reducing circuitry may be used.

At step 254, operation of the notification appliances 24 and 26 is verified. For manual verification, flow passes to step 256, where the voltage at the input terminals 150 and 152 (FIG. 2) and 154 and 156 (FIG. 3) of each notification appliance 24 and 26, respectively, may be manually measured with a meter. In step 258, the measured voltage level is then compared to a preset level, such as a low input voltage threshold, established for the type of notification appliance 24 and 26 being tested.

Returning to step 254, flow passes to step 260 for semi-automatic verification. At step 260, the notification appliances 24 and 26 may sample the input voltage as previously discussed in the method of FIG. 5. For example, the voltage monitor 60 of the notification appliance 24 may sample the lines 62 and 64. In step 262, the control logic 58 compares the input voltage level to a value stored in memory 66, such as a low input voltage threshold or a predetermined voltage range.

At step 264, the notification appliances 24 and 26 indicate via an output the result of the low input voltage test. A result status may be indicated by way of the fault indicator 72 and 144, the strobe 52 and 114 or horn 54 and 116, identifying whether the notification appliance 24 and 26 is functional or non-functional at the low input voltage level. For example, the control logic 58 may signal a pass condition with a fast pulse and a fail condition with a slow pulse on the fault indicator 72. An operator or technician would then verify the status at each of the notification appliances 24 and 26.

Alternatively, some or all notification appliances 24 and 26 may utilize a separate component for reporting a problem, such as the shunting component 162 (FIG. 3), which may be configured to place a resistance across the line to indicate a fault on the circuit. This embodiment would indicate a fault at the NAC level rather than at the level of the notification appliance 24 and 26. By way of example, the FACP 14 may monitor the NAC for current based on an expected range.

Returning to step 254, flow passes to step 266 for automatic verification. At step 266, the input voltage is sampled at the notification appliance 24 and 26 as in step 260. At step 268, the input voltage is compared to a low input voltage threshold or voltage range as discussed in step 262. In step 270, the control logic 58 sends a test result to the FACP 14, indicating whether the input voltage level creates a pass or fail condition for the particular notification appliance 24.

At step 272, the FACP 14 logs data from each notification appliance 24, creating a file stored in memory 88 that would be available for review by service and public safety personnel. The low input voltage test may automatically generate a report on the status of notification appliances 24 interconnected to each NAC. It should be understood that the system 10 may be tested using a combination of testing methods. For example, the hardwired notification appliance 26 may be tested using the semi-automatic method, while addressable notification appliances 24 may be tested using the automatic method.

In another embodiment, for either the semi-automatic or automatic mode, a maximum voltage drop may be defined for any notification appliance 24 and 26 on the system 10. The maximum voltage drop is stored in memory 66 and 112, respectively, and represents the worst-case condition. The notification appliance 24 and 26 samples the input voltage and compares it to a maximum voltage drop. If the input voltage is less than the maximum voltage drop, a fault may be indicated. For addressable notification appliances 24, notification appliances 24 may send the measured input voltage level to the FACP 14, which compares it to values in a maximum voltage drop look-up table, or the notification appliance 24 may send a pass/fail status to the FACP 14.

In addition, it may be desirable to identify if capacity exists to add additional devices on to an existing circuit. The voltage drop level may be logged at the furthest distance on a conventional NAC, or the furthest distances along an SLC. Alternatively, a minimum low input voltage level may be determined for the NAC or SLC. The voltage drop level and or minimum low input voltage level may be used to determine how much margin is available based on voltage drop estimates for notification appliances 24 and 26.

One or more methods or combinations of methods for verifying and testing a low input voltage condition may be incorporated into the fire alarm system 10, such that verification of the installation of notification appliances 24 and 26 is automated or semi-automated. This would decrease labor costs and associated time for the installer. Safety officials, such as AHJs, would also benefit from reduced time and effort spent in verifying an installation. In addition, generating a report as described above may allow a hard copy record of the state of an installation for the purpose of compliance with state or local codes and/or insurance requirements.

While the invention has been described in terms of various specific embodiments, those skilled in the art will recognize that the invention can be practiced with modification within the spirit and scope of the claims.

What is claimed is:

1. A method for verifying operation of notification appliances on a notification appliance network during low input voltage conditions, comprising:

measuring an output voltage at a control panel, the output voltage being supplied to a network;

measuring an input parameter at a notification appliance connected to the network; and calculating a supply line impedance for the notification appliance based on at least one of the output voltage and the input parameter, at least one of the supply line impedance, the output voltage and the input parameter being used to determine a pass/fail condition for the notification appliance during a low voltage condition.

2. The method of claim 1, wherein the input parameter being an input voltage, the method further comprising calculating a current draw for the notification appliance based on the input voltage and a power consumption value associated with the notification appliance when receiving the input voltage, the pass/fail condition being further determined based on the current draw.

3. The method of claim 1, wherein the input parameter being an input voltage, the method further comprising:

identifying at least one of a minimum low input voltage level for the notification appliances connected to the network and a voltage drop level for the network; and determining available margin for adding at least one further notification appliance to the network based on at least one of the minimum low input voltage level and the voltage drop level.

4. The method of claim 1, wherein the notification appliances are constant power devices.

5. The method of claim 1, wherein the network is one of a notification appliance circuit and a signaling line circuit.

6. The method of claim 1, the measuring an input parameter step further comprising measuring at least one of an input voltage and a current draw.

7. The method of claim 1, wherein at least one of the notification appliance and the control panel perform electronic measurement of the input parameter and the output voltage, respectively.

8. The method of claim 1, further comprising identifying a power consumption value associated with the notification appliance, the power consumption value being responsive to an output setting of the notification appliance and the input parameter, the pass/fail condition being further determined based on the power consumption value.

9. The method of claim 1, further comprising identifying a power consumption value of the notification appliance based on at least one of the input parameter and an output setting of the notification appliance, the notification appliance sending the power consumption-value to the control panel.

10. The method of claim 1, wherein the notification appliance performing electronic measurement of the input parameter, the notification appliance forwarding the input parameter to the control panel.

11. The method of claim 1, further comprising:

storing a look-up table at the notification appliance, the look-up table providing predetermined calculations for a low input voltage level based on at least one of output voltages at the control panel, input voltages at the notification appliance and power consumption values; and accessing the look-up table to determine the pass/fail condition.

12. The method of claim 1, further comprising:

measuring a second input parameter at a second notification appliance connected to the network; and calculating a second supply line impedance for the second notification appliance based on at least one of the output voltage and the second input parameter, at least one of the second supply line impedance, the output voltage and the second input parameter being used to determine a pass/fail condition for the second notification appliance during a low voltage condition.

13. A method for verifying installation of notification appliances on a notification appliance network, comprising:

reducing an output voltage from a control panel to a level based on a low line condition, the output voltage being supplied to a network;

measuring an input voltage at a notification appliance connected to the network;

comparing the input voltage to a low input voltage threshold; and providing one of a pass indication and a fail indication based on the comparing step.

14. The method of claim 13, further comprising initiating a low input voltage test at the control panel, the steps of the method being performed automatically.

15. The method of claim 13, further comprising outputting the pass and fail indications on a fault indicator at the notification appliance, the fault indicator having means for at least one of audible indication and visible indication.

16. The method of claim 13, further comprising compiling a report at the control panel, the report identifying the pass and fail indication for the notification appliance.

17. An alarm system, comprising:

a control panel providing an output voltage to a network;

a notification appliance communicating with the control panel over the network, the notification appliance including an alarm indicator and a control module configured to turn on/off the alarm indicator, the control module configured to receive command instructions from the control panel and to sample an input level, the control module directing operation of the alarm indicator based on the command instructions; and a fault indicator for indicating a relationship between the input level and a low line condition.

18. The system of claim 17, the control panel further comprising voltage reducing circuitry for reducing the output voltage to a level based on the low line condition, the voltage reducing circuitry further comprising at least one of a switchmode regulator, a linear pass element, and feedback circuitry.

19. The system of claim 17, wherein the input level being an input voltage level, the notification appliance further comprising a voltage comparator for comparing the input voltage level to a low input voltage threshold level, the fault indicator further indication the relationship based on the low input voltage threshold level.

20. The system of claim 17, the fault indicator further comprising a shunting component in communication with the notification appliance, the shunting component being moved into communication with input lines providing the output voltage from the control panel to indicate a failure condition.

21. The system of claim 17, the control module configured to forward the input level to the control panel.

22. The system of claim 17, the control panel further comprising means for calculating a supply line impedance based on at least one of the input level, the output level, and a power consumption value associated with the notification appliance.

* * * * *